US005720144A

United States Patent [19]

Knudson et al.

[11] Patent Number: 5,720,144

[45] Date of Patent: Feb. 24, 1998

[54] METAL BEAMS WITH THERMAL BREAK AND METHODS

[76] Inventors: Gary A. Knudson, 30401 Heavenly Ct., Evergreen, Colo. 80439; Patrick D. Flood, 276 Eagle Dr., Golden, Colo. 80403

[21] Appl. No.: 612,107

[22] Filed: Mar. 7, 1996

[51] Int. Cl.[6] ..... E04C 3/07; E04C 3/29

[52] U.S. Cl. ..... 52/731.9; 52/731.1; 52/717.01; 52/745.19; 52/588.1; 52/731.7; 29/897.35; 29/416; 29/509

[58] Field of Search ..... 52/717.02, 730.1, 52/731.1, 731.7, 731.9, 733.2, 745.19, 528, 588.1, 536, 537, 542, 730.4, 730.5, 731.2, 731.3; 29/897.35, 897.3, 416, 509, 505

[56] References Cited

U.S. PATENT DOCUMENTS

| | | | |
|---|---|---|---|
| 3,319,330 | 5/1967 | Patry et al. | 29/509 X |
| 3,353,318 | 11/1967 | Bacher | 52/588.1 X |
| 3,872,633 | 3/1975 | Altosaar et al. | 52/731.9 X |
| 3,967,430 | 7/1976 | Knudson | 29/509 X |
| 4,016,700 | 4/1977 | Blomstedt . | |
| 4,071,995 | 2/1978 | Farmer . | |
| 4,131,980 | 1/1979 | Zinnbauer | 29/509 X |
| 4,161,811 | 7/1979 | Nyssen | 29/509 X |
| 4,196,554 | 4/1980 | Anderson et al. | 52/528 X |
| 4,267,679 | 5/1981 | Thompson | 52/588.1 |
| 4,283,897 | 8/1981 | Thompson | 52/588.1 X |
| 4,435,936 | 3/1984 | Rutkowski . | |
| 4,619,098 | 10/1986 | Taylor . | |
| 4,638,615 | 1/1987 | Taylor . | |
| 4,688,366 | 8/1987 | Schmidt | 52/731.1 |
| 4,691,493 | 9/1987 | Larsen . | |
| 5,074,138 | 12/1991 | Miller | 29/509 X |
| 5,117,602 | 6/1992 | Marschak . | |
| 5,228,257 | 7/1993 | Bowersox et al. | 52/588.1 |
| 5,285,615 | 2/1994 | Gilmour . | |
| 5,313,762 | 5/1994 | Guillemet | 52/171.1 |
| 5,355,649 | 10/1994 | Berridge | 52/588.1 X |
| 5,390,466 | 2/1995 | Johnson et al. | 52/731.1 X |
| 5,424,111 | 6/1995 | Farbstein . | |
| 5,519,978 | 5/1996 | Sucato et al. | 52/733.2 X |
| 5,555,698 | 9/1996 | Mandish | 52/745.17 |
| 5,568,714 | 10/1996 | Peterson | 52/717.02 X |

*Primary Examiner*—Robert Canfield
*Attorney, Agent, or Firm*—Ancel W. Lewis, Jr.

[57] ABSTRACT

A metal beam with a thermal break between opposite sides and method of making is disclosed. In a first embodiment a huck rivet extends through aligned holes in a pair of opposed beam sections having a base wall portion and a side wall portion. In a second embodiment a punch/swedge operation forms a rivet in the base wall portion of one beam section that extends through the other base wall portion of the other beam section. In a third embodiment a series of spaced, alternating tabs and recesses are formed in the beam section and the tabs overlap and are riveted at overlapping tabs only to form a gap in the formed beam. In a fourth embodiment oppositely opening hooks are formed in the inner sections of first and second beam sections that interfit and are seamed together to fasten the two beam sections with a continuous seam along the center of a composite beam.

8 Claims, 5 Drawing Sheets

METAL BEAMS WITH THERMAL BREAK AND METHODS

TECHNICAL FIELD

This invention relates generally to sheet metal beams or studs and more particularly to sheet metal beams that are used as the tracks and studs of a building frame assembly.

BACKGROUND ART

In the past, wooden beams referred to as studs have been used as the top and bottom beams of a building frame assembly and more recently sheet metal beams or studs have been provided for this purpose.

There are thermal insulation problems inherently associated with steel or sheet metal beams. Steel or sheet metal beams in frames produce a thermal bridge between either side of a wall frame, joist, or truss member or like metal structural components. This thermal bridging readily transfers heat across metal members, which results in excessive heating/cooling costs, condensation, and accelerated thermal rot in sheeting materials like drywall and siding. Heat transfer utilizes three basic mechanisms; conduction, radiation, and convection. With typical wood framing, the wood itself is an insulator, which eliminates conduction. Effective thermal sheeting and batten insulation prevent radiation across the frame and convection within the dead space. With steel sheet metal framing, the metal conducts heat across the frame. Sheeting and batten insulation reduce radiation and convection, but no satisfactory means has been provided to prevent conduction. Several approaches to reducing conduction involved reducing the amount of material in the web of a sheet metal beam, but no method to completely eliminate conduction in a sheet metal beam has heretofore been provided.

The patents to Farmer U.S. Pat. No. 4,071,995, Larsen U.S. Pat. No. 4,691,493 and Marschak U.S. Pat. No. 5,117,602 are directed to metal beams fabricated from roll-formed beam half sections but none teach a heat insulating layer interposed between the metal of opposite beam half sections.

Blomstedt U.S. Pat. No. 4,016,700, Rutkowski U.S. Pat. No. 4,435,936, Taylor U.S. Pat. Nos. 4,619,098 and 4,638,615 and Gilmour U.S. Pat. No. 5,285,615 relate to metal beams but have a thermal reduction feature such as slits, dimples or protuberances.

DISCLOSURE OF THE INVENTION

A metal beam with a thermal break between opposite sides has first and second beam sections each with a base wall portion and a side wall portion which form a channel member with opposed, spaced side wall portions and a base wall when the two sections are fastened together. A thermal insulation layer is fastened between the first and second base portions to thermally isolate or provide a thermal break between the first and second beam sections.

In a first embodiment there are opposed first and second beam sections and the base wall portion of one beam section overlaps the base wall portion of the other beam section and aligned holes in the base wall portions are of an equal size. A tubular rivet body with a heat insulation layer on the outside is compressed at the ends to form a huck rivet to secure the beam sections together to form a composite beam.

In a second embodiment there is a larger hole over a smaller hole in the overlapping base wall portions with a heat insulation layer between the overlapping base wall portions and a punch and die tool uses the material of the bottom wall portion surrounding the smaller hole to swedge form a rivet to fasten the bottom wall portions to form a composite beam.

In a third embodiment opposed first and second beam sections each with oppositely disposed inner edges and inner sections have a series of spaced, alternating tabs and recesses. Each tab has a hole. These beam sections preferably are provided by longitudinally splitting a channel beam or roll forming separate beam sections. These first and second beam sections are disposed side by side, the holes are aligned and a thin gap is provided between the opposed inner edges and only the opposed tabs overlap with a layer of thermal insulation between opposed tabs. Either a huck rivet or a punch/swedge rivet may be used on the overlapping tabs to fasten these beam sections to form a composite beam.

In a fourth embodiment opposed first and second beam sections are seamed together along opposed inner sections of the bottom wall portions. These beams have adjacent inner sections of the bottom wall portions that are gradually formed as seam section shapes, preferably oppositely facing interfitting hooks with a layer of heat insulation disposed between the hooks by a continuous roll forming process to secure the two beam sections together with a tight, continuous, seam to form a composite beam.

BRIEF DESCRIPTION OF THE DRAWINGS

Details of this invention are described in connection with the accompanying drawings which like parts bear similar reference numerals in which.

DETAILED DESCRIPTION

Figure 1:
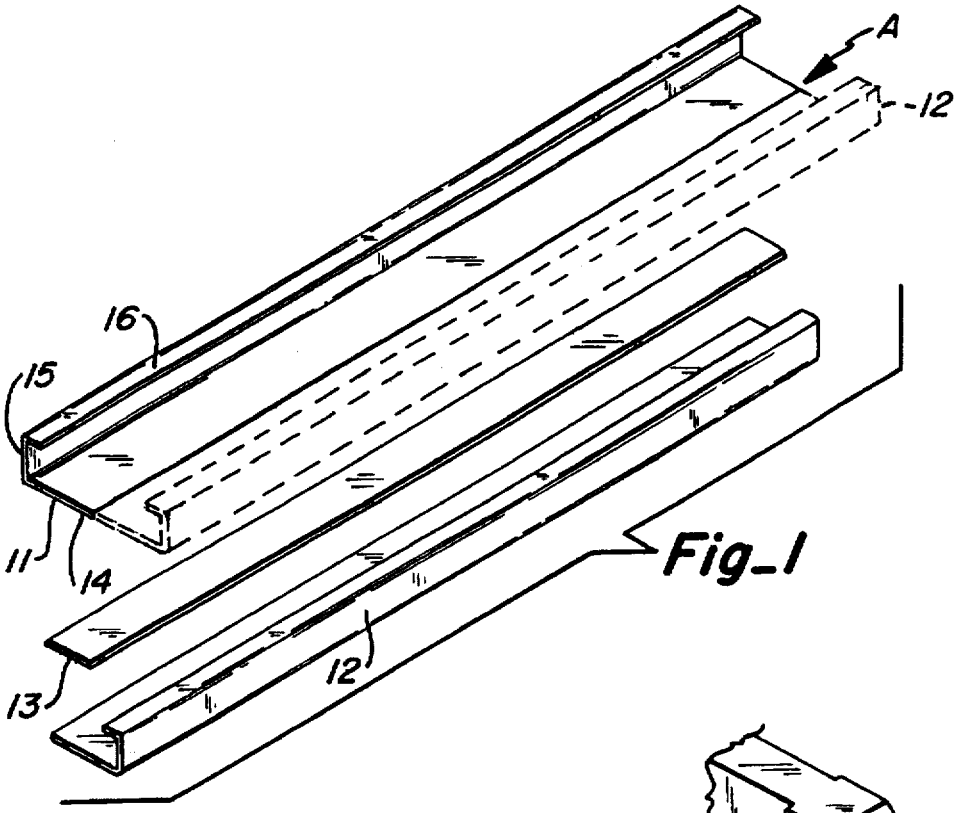
FIG. 1 is an exploded perspective view of the parts of a metal beam in a separated condition before assembly with one of the beam sections shown in dashed lines and the opposed beam section in full lines.
Figure 2:
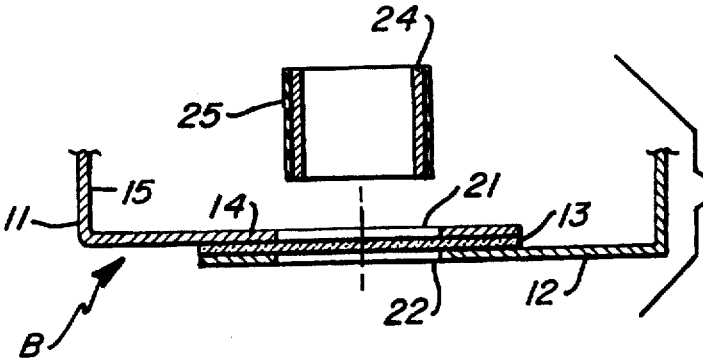
FIG. 2 is a cross-sectional view of the parts of the metal beam prior to being fastened with a huck rivet tubular body shown prior to being placed in a fastening position in the holes.
Figure 3:
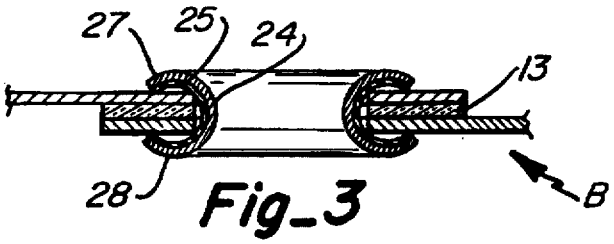
FIG. 3 is a sectional view showing the huck rivet flanged at both ends to fasten the beam sections tightly together.

Referring now to FIGS. 1–3 there is shown a pair of oppositely disposed, roll formed, generally L-shaped top beam section 11 and bottom section 12 with portions that are overlapped with a layer of heat or thermal insulation 13 placed between the overlapping portions. Beam sections 11 and 12 are fastened together to form a generally channel-shaped composite beam B (FIG. 2). Each of the beam sections 11 and 12 are of an identical size and shape and have a base wall portion 14, a side wall portion 15 extending transverse to the base wall portion and an inturned top flange portion 16. These beam sections 11 and 12 may be formed individually using a roll forming machine or in the alternative as shown in FIG. 1 an oversized channel-shaped member A with parallel spaced side walls and inturned top flange portions is roll formed and is longitudinally cut or slit down the center of the bottom wall of a single channel-shaped beam to form the two beam sections 11 and 12 that are then overlapped and has the layer of heat insulation 13 placed between the overlapping portions of the opposed base wall portions of the beam sections as shown in FIG. 2.

There are two preferred methods of fastening or attaching the above described beam sections 11 and 12. The first method is herein referred to as roll riveting. In the roll riveting method a hole 21 is formed in the base wall portion of beam section 11 and a hole 22 of the same size as hole 21 is formed in the base wall portion of beam section 12. These holes 21 and 22 preferably are stamped or punched. The top beam section 11 overlaps the bottom beam section 12 with holes 21 and 22 arranged in alignment. A layer of heat or thermal insulation 13 is placed between the two overlapping bottom wall portions so there is no metal to metal contact between the two sections and a huck rivet 24 extends through the aligned holes 21 and 22. The huck rivet begins as a cylindrical tubular body of a selected length with a layer of heat or thermal insulation 25 on the outer surface. A rivet forming tool is used having oppositely positioned dies and a means to apply pressure from opposite directions to the dies to flatten both ends of the tubular body. This pressure produces end rivet heads 27 and 28 of a semicircular shape. The tool is similar to the one disclosed in my copending application Ser. No. 289,272 discussed hereafter but has conventional opposed rivet head forming dies.

Figure 6:
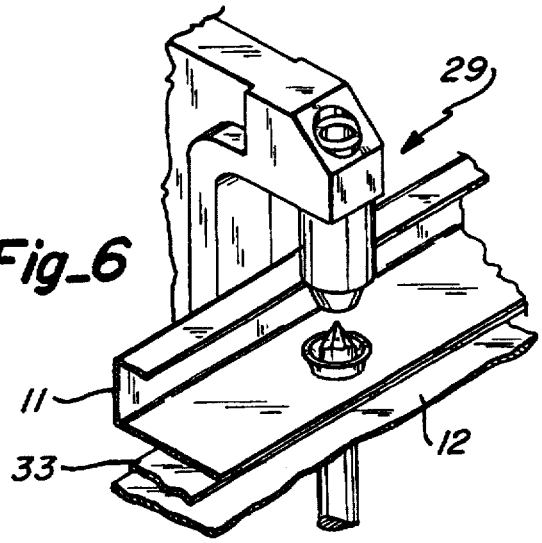
FIG. 6 is a perspective view of a tool for performing the punch/swedge riveting operation shown in FIGS. 4 and 5.
Figure 4:
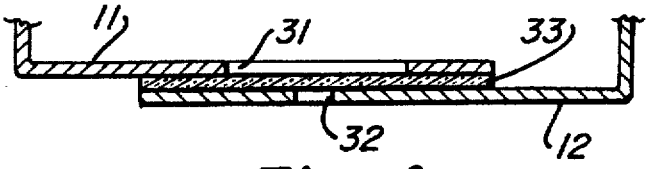
FIG. 4 is a sectional view showing two beam sections with a larger hole over a smaller hole.
Figure 5:
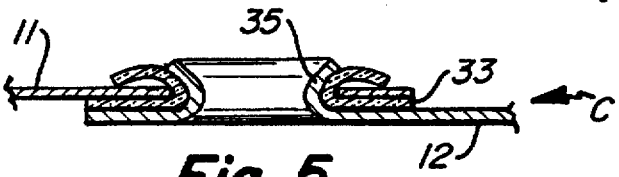
FIG. 5 is a sectional view showing the two beam sections of FIG. 4 fastened with a punch/swedge riveting operation.
Figure 8:
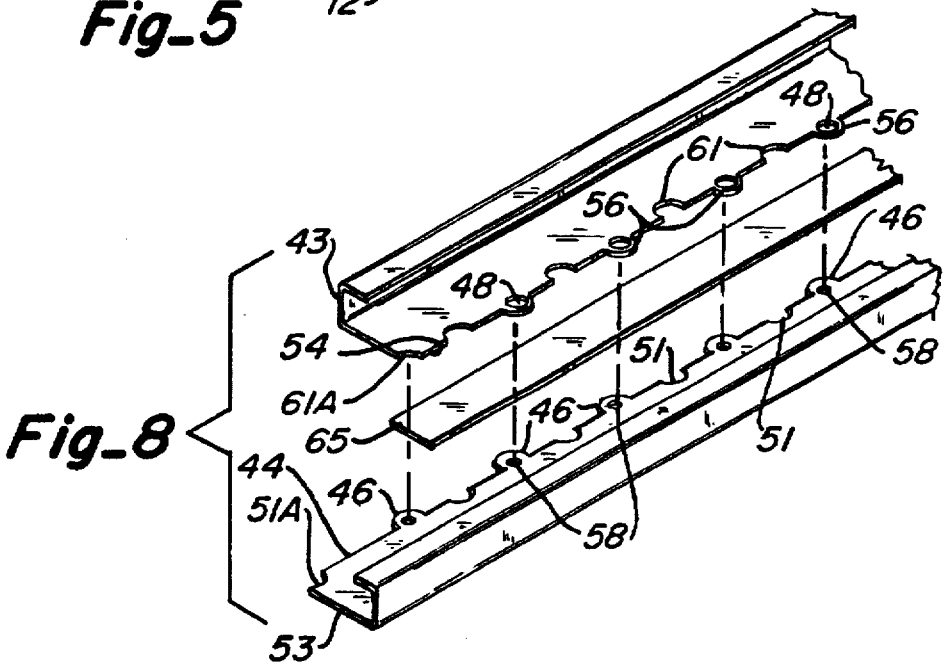
FIG. 8 is an exploded perspective view of the opposed two beam sections punched and cut from the beam of FIG. 7 shown in a separated condition before assembly.
Figure 7:
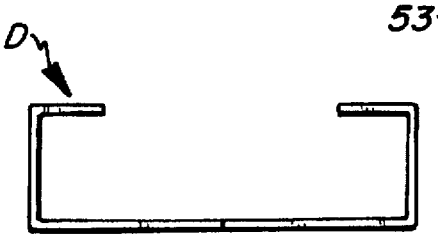
FIG. 7 is an end view of a channel-shaped beam.

A second method of attaching the beam sections 11 and 12 is called the punch/swedge riveting. As shown in FIGS. 4 and 5 in this procedure a larger hole 31 is formed in the bottom wall portion of a top beam section 11 and a smaller hole 32 in the bottom beam section 12. The two bottom wall portions are overlapped and the centers of the holes 31 and 32 are aligned. A layer of heat insulation 33 is placed between the overlapping portions of the beam sections and then a rivet fastening die is used to swedge the material of the bottom wall portion of the bottom 12 surrounding hole 32 to form a circumferential rivet head 35 above the top surface of the bottom wall portion 12. This procedure produces a channel-shaped composite beam designated C. Referring now to FIG. 6 there is shown a tool 29 and dies and operation for performing the punch/swedge riveting. The details are disclosed in my copending application Ser. No. 289,272 and incorporated herein by reference.

In yet a third embodiment shown in FIGS. 7–11 a channel-shaped member D is formed preferably using a continuous roll forming process. Preferably a punch or stamping operation is used to punch a selected length of the member to form a first beam section 43 with an inner edge 54, a series of alternating spaced, semi-circular tabs 56 extending out from the inner edge 54 and semi-circular recesses 61 extending in from the inner edge 54. A larger hole 48 is provided in each tab 56. The selected length of the beam provides half recesses 51A at each end.

Figure 9:
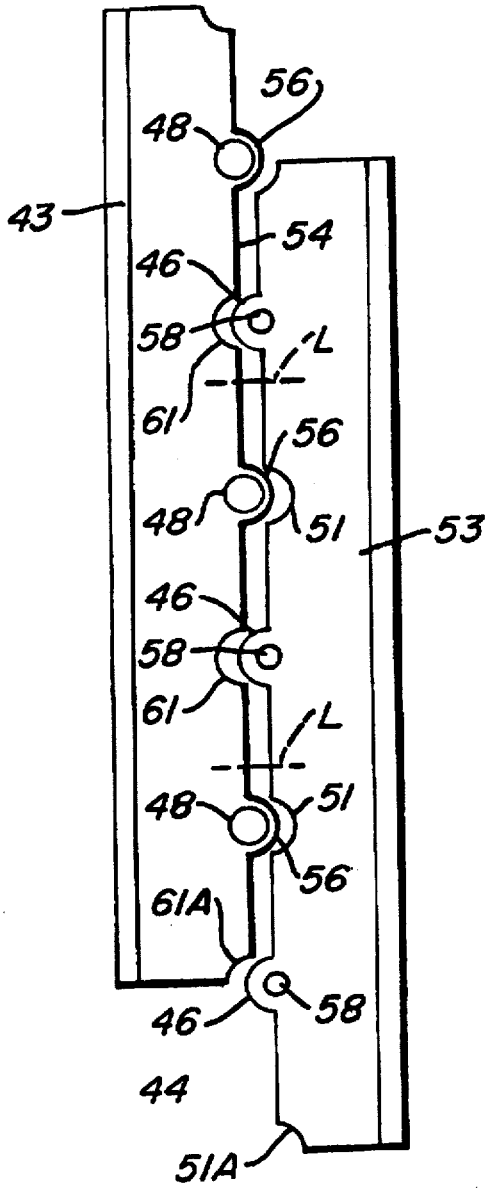
FIG. 9 is a top plan view of the two opposed beam sections.
Figure 10:
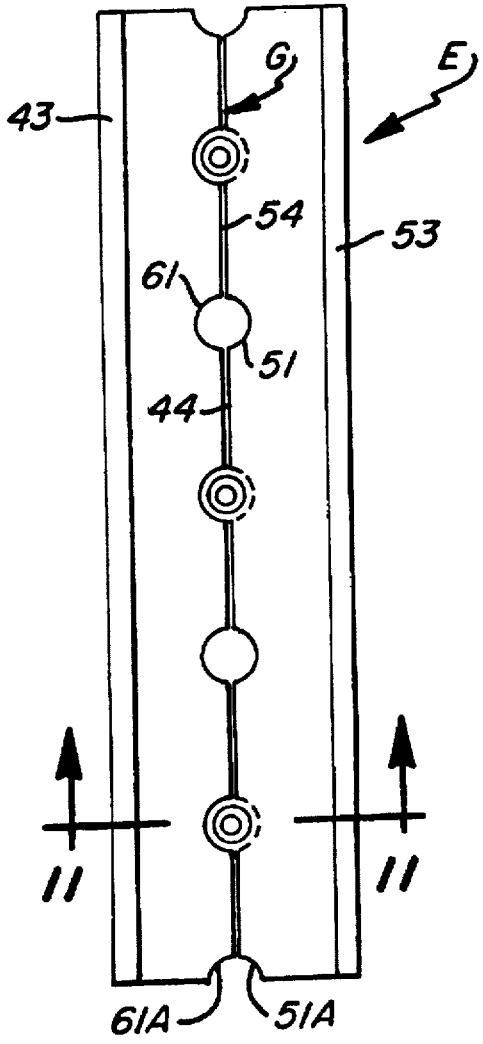
FIG. 10 is a top view of the assembled beam using the sections shown in FIGS. 8 and 9.
Figure 11:
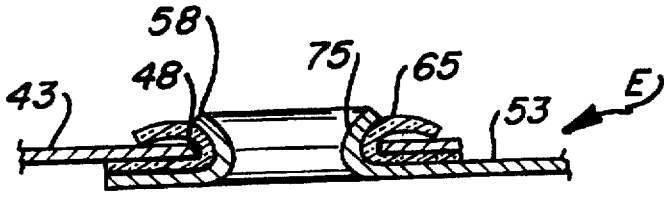
FIG. 11 is a sectional view taken along lines 11—11 of FIG. 10.
Figure 12:
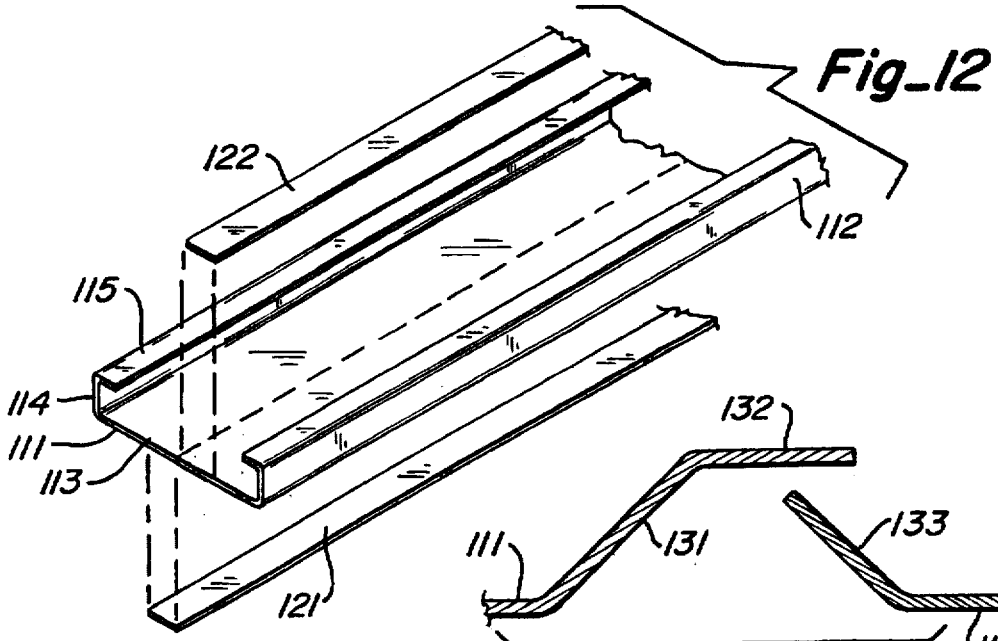
FIG. 12 is an exploded view of two opposed beam sections shown separated by a dashed line with two layers of heat insulation that are shown in a separated position.

A second beam section 53 opposite the first beam section 43 has an inner edge 44, a series of spaced, alternating semi-circular tabs 46 extending out from the inner edge 44 and semi-circular recesses 51 extending in from the inner edge 44. A smaller hole 58 is provided in each tab 46. The length along the member C for which punching is accomplished is a selected distance greater than the distance between a tab and a recess as indicated by the distance between lines L. Once the two beam sections 43 and 53 are formed to a selected length after successive punching the opposed inner edges of the two seams are spaced apart and the tabs from opposite beam sections overlap as is shown in FIG. 9 with a layer of heat or thermal insulation 65 between the overlapping tabs. A punch/swedge riveting operation as above described is shown as used to form a rivet head 75 at the top of the base wall portion of the second base section using the material of the base wall portion of second beam section 53 to form a generally channel-shaped composite beam D.

When the beam sections 43 and 53 are placed side by side the larger hole 48 is over the smaller hole 58. In this way a major portion of the bottom wall portions of the beam sections along opposed edges 44 and 54 form a gap G and do not overlap. This process can also use the roll riveting technique above described by using equal sized holes and a huck rivet to fasten the sections together as above described.

Referring now to FIGS. 12–19 of the drawings there is shown a pair of oppositely disposed roll-formed generally L-shaped first and second beam sections 111 and 112. Each of the beam sections 111 and 112 are of an identical size and shape and have a base wall portion 113, a side wall portion 114 extending transverse to the base wall portion and an inturned top flange portion 115. These beam sections may be made by having each section being continuously roll-formed or by roll-forming an oversized channel-shaped member and then longitudinally splitting that member down the middle as is represented in dashed lines in FIG. 12. In the first and second L-shaped beam sections 111 and 112 the adjacent inner edge sections are gradually roll-formed as shown in FIGS. 13–19 to form first and second seam shapes that are seamed together to provide a continuous seam S which fastens the base wall portions of the two together to form a generally channel-shaped composite beam F. Between the first and second beam sections during the roll forming process there are added two heat or thermal insulation layers 121 and 122 which will thermal isolate the first and second beam sections. Each of the first and second beam shapes preferably are continuously roll formed to form the connecting seam S.

Figure 13:
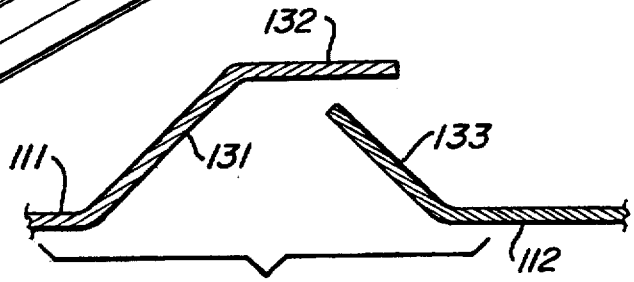
FIG. 13 is a sectional view showing the first stage of inner section shaping of the bottom wall portions of the two beam sections.
Figure 14:
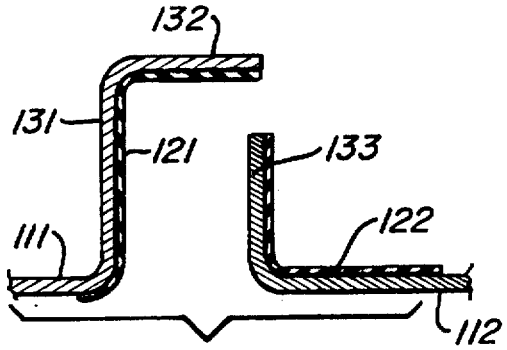
FIG. 14 is a sectional view showing a second stage of inner section shaping with the heat insulation in place.
Figure 15:
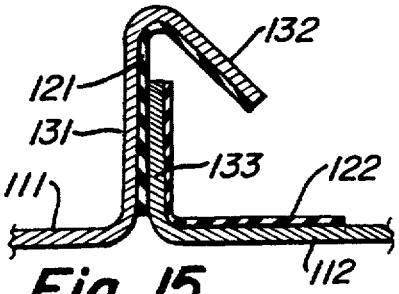
FIG. 15 is a sectional view showing a third stage of inner section shaping.
Figure 16:
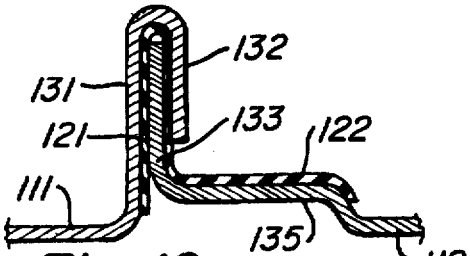
FIG. 16 is a sectional view showing a fourth stage of inner section shaping.
Figure 17:
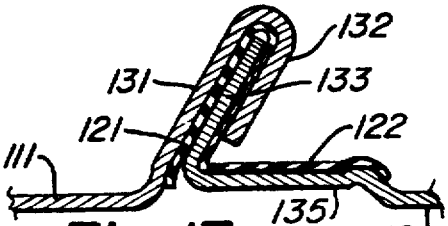
FIG. 17 is a sectional view showing a fifth stage of inner section shaping.
Figure 18:
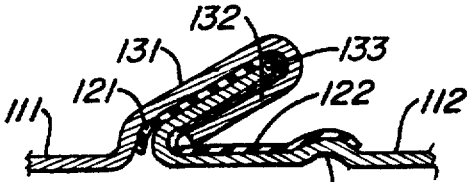
FIG. 18 is a sectional view showing a sixth stage of inner section shaping.
Figure 19:
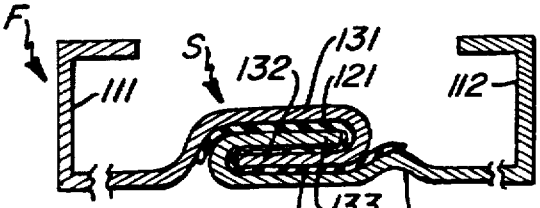
FIG. 19 is a sectional view showing the final stage of inner section shaping which form the continuous seam in the central part of the beam.
Figure 20:
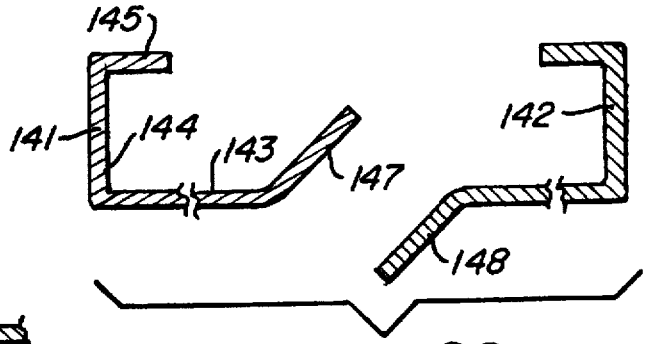
FIG. 20 is a sectional view showing the first stage of inner section shaping of two beams in yet another embodiment.
Figure 21:
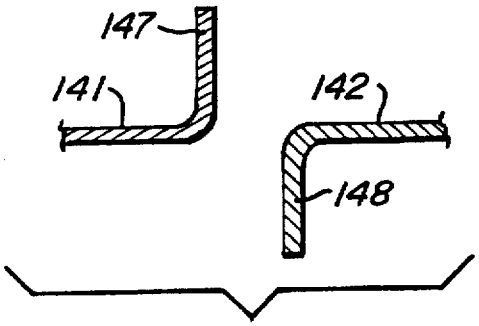
FIG. 21 is a sectional view showing a second stage of inner section shaping.
Figure 22:
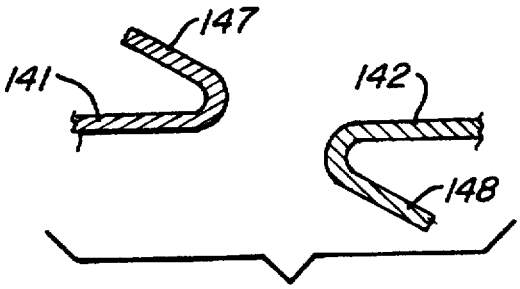
FIG. 22 is a sectional view showing a third stage of inner section shaping.

Referring now to FIG. 13 an inner section of the base wall portion of first beam section 111 is turned up through an angle of about 45 degrees to form an outwardly inclined section 131 and an end section 132 is bent or turned back down through an angle of about 45 degrees so an end section 132 is horizontally disposed. The opposite inner section 133 of beam section 112 is turned up through an angle of about 45 degrees. The second stage (FIG. 14) turns inner section 131 another 45 degrees so this section is transverse to the plane of back wall portion 113 and section 132 is now transverse or normal to the associated section 131. A thermal layer 121 is positioned along the outer face of inner section 131 and under inner section 132. Thermal layer 122 is positioned along an inner face of inner section 133 and the top face of a portion of the bottom wall of beam section 112 as shown in FIG. 14. At the next stage (FIG. 15) the two upright sections 131 and 133 are brought together and section 132 is turned down through an angle of about 45 degrees. At stage four (FIG. 16) the bottom wall portion of the first beam section 111 is turned through an angle of about 90 degrees a selected distance along the bottom wall portion from inner section 133 to provide a stepped up section 135 and at the same time end section 132 is turned down through another angle of about 45 degrees to form a hook that embraces inner section 133 and layer 131. At stage five (FIG. 17) the hook made of sections 131 and 132 is turned through an angle of about 30 degrees and in the succeeding stage six (FIG. 18) is turned about another 30 degrees while at the same time pushing step section down to form an indentation or a dimple 136 in the bottom surface of the bottom wall portion of beam section 112 that is inwardly of the hook of the opposite beam section 111. At stage seven (FIG. 19) the hook made of sections 131 and 132 is turned down another 30 degrees to a flat or horizontal position to complete seam S. This seam S is known in the trade as a Pittsburgh-type seam and has been previously used in downspouts.

Referring now to FIGS. 20–25, in yet another embodiment there is shown a pair of oppositely disposed, roll-formed, generally L-shaped first and second beam sections 141 and 142. Each of the beam sections are identical in size and shape and again have the base wall portion 143, side wall portion 144, and top flange portion 145. These beam sections may be made by having each section continuously roll-formed or by roll-forming an oversized channel-shaped member and then longitudinally slitting that member down the middle as above described. At the first stage (FIG. 20) an inner section 147 of the base wall portion 143 of the first beam section is turned up at an angle of about 30 degrees while the opposite inner section 148 on the base wall portion of the second beam section 142 is turned down at an angle of about 30 degrees. At the next stage (FIG. 21) inner section 147 is turned up about 60 degrees to be upright and at about 90 degrees to the associated base wall portion and inner section 148 is turned down about 60 degrees to be an about 90 degrees to the associated base wall portion. At the third stage (FIG. 22) the inner section 147 is turned back another about 45 degrees and inner section 147 back another angle about 45 degrees. At stage 4 (FIG. 23) the inner sections 147 and 148 are turned another about 45 degrees to extend back parallel to the associated back wall portion and form a hook. A layer of heat insulation 151 is placed over inner section 147 and a layer of heat insulation 152 is placed under inner section 148. The two hooks are then hooked together so there is in effect a hook in a hook with the openings in the hooks facing in opposite directions and the insulation layers 151 and 152 separate the adjacent metal sections. In the final stage an indentation or dimple 155 is formed in base wall portion 143 inwardly of the hook. The hook sections then are crimped down to form a tight continuous seam T and thereby form a generally channel-shaped composite beam G.

Figure 23:
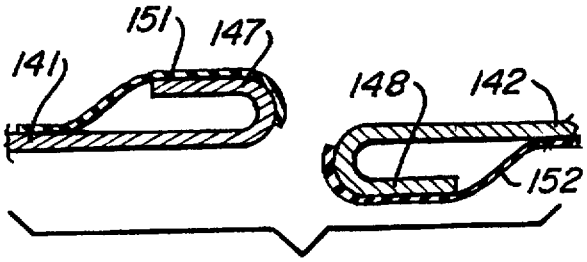
FIG. 23 is a sectional view showing a fourth stage of further inner section shaping and the application of two layers of thermal insulation.
Figure 23A:
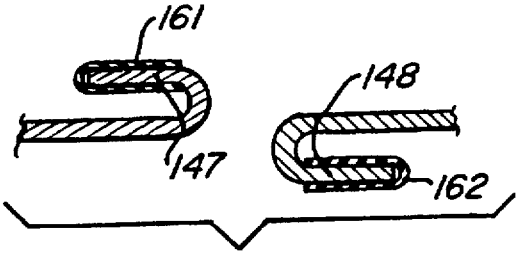
FIG. 23A is a sectional view of an alternative form of insulation layer for each beam section.
Figure 24:
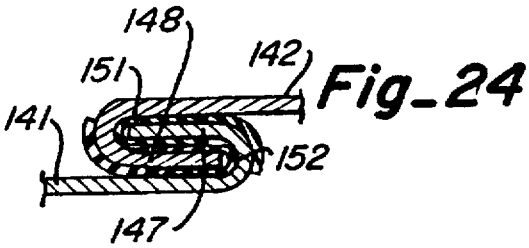
FIG. 24 is a sectional view showing the inner sections brought together.

Referring now to FIG. 23A an alternative to the strips of heat insulation layers 151 and 152 is to provide a U-shaped strip or extrusion 161 and 162 that will slide over the turned back end section of the hooks before the hooks are hooked together.

Figure 26:
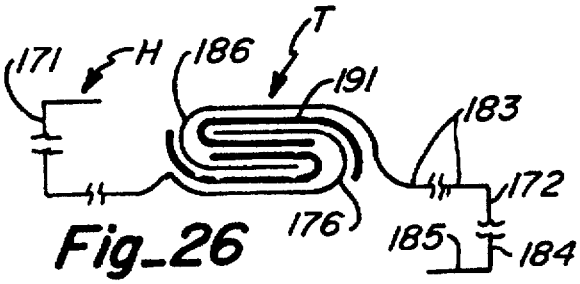
FIG. 26 is a schematic diagram of Z-section beam embodying features of the present invention.
Figure 25:
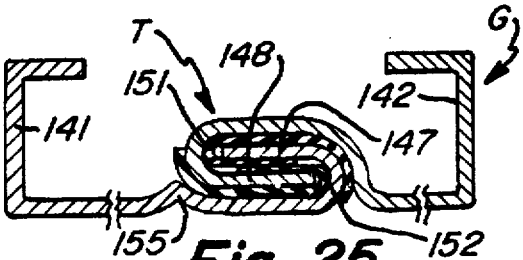
FIG. 25 is a sectional view showing a final stage and the position of the inner sections after a final seaming operation to form the composite beam.

Referring now to FIG. 26 there is shown a Z-section beam H comprised of a first beam section 171 and a second beam section 172. The first beam section 171 is the same as the first beam section 141 above described and has a base wall portion, upturned side wall portion and in inturned top flange portion along with an up and backturned hook 176 at the inner end of the base wall portion. The second beam section 172 has a base wall portion 183, a downturned side wall portion 184 and an inturned top flange portion 185 with a down and backturned hook 186 at the inner end of the base wall portion. A layer of heat insulation 191 is placed between the hooks so there is no metal-to-metal contact to form a tight, continuous seam T similar to the layers 151 and 152 and the seam shown in FIG. 25. It is understood that the Z-section beam H above described may be made from any of the above described processes involving riveting, swedging and roll forming.

Although the present invention has been described with a certain degree of particularity, it is understood that the present disclosure has been made by way of example and that changes in details of structure may be made without departing from the spirit thereof.

What is claimed is:

1. A metal beam with a thermal break between opposite sides comprising:

a first metal beam section including a first base wall portion and a first side wall portion extending transverse to said first base wall portion, a second metal beam section opposite said first beam section, said second beam section including a second base wall portion and a second side wall portion extending transverse to said second base wall portion, said first and second base wall portions being oppositely disposed and having adjacent first and second inner edges and first and second inner sections, said first and second base wall portions having aligned holes of substantially equal size, said first base wall portion overlapping said second base wall portion to provide overlapping portions, a thermal barrier between said overlapping portions of said first and second base wall portions to thermally isolate said first and second beam sections, and fastening means to mechanically fasten said first and second base wall portions together adjacent said inner edges with said thermal barrier between opposed portions of said first and second base wall portions to form a structural composite beam, said fastening means including a tubular body extending through said holes that is flattened at the ends to form a rivet with opposed flattened rivet heads.

2. A metal beam as set forth in claim 1 wherein said thermal barrier is provided by a layer of thermal insulation.

3. A metal beam with a thermal break between opposite sides comprising:

a first metal beam section including a first base wall portion and a first side wall portion extending transverse to said first base wall portion, a second metal beam section opposite said first beam section, said second beam section including a second base wall portion and a second side wall portion extending transverse to said second base wall portion, said first and second base wall portions being oppositely disposed and having adjacent first and second inner edges and first and second inner sections extending in from associated of said first and second inner edges, said first and second base wall portions having aligned holes, said first base wall portion overlapping said second base wall portion to provide overlapping portions, the hole in said first base wall portion being larger than the hole is said second base wall portion, a thermal barrier between said overlapping portions of first and second base wall portions to thermally isolate said first and second beam sections, and fastening means to mechanically fasten said first and second base wall portions together adjacent said inner edges with said thermal barrier between opposed portions of said first and second base wall portions to form a structural composite beam, said fastening means including a portion of the material surrounding a smaller hole in said second base wall portion being swedged to extend up through said larger hole and being flattened down against the top surface of said first base wall portion to form a rivet head.

4. A metal beam with a thermal break between opposite sides comprising:

a first metal beam section including a first base wall portion and a first side wall portion extending transverse to said first base wall portion, a second metal beam section opposite said first beam section, said second beam section including a second base wall portion and a second side extending transverse to said second base wall portion, said first and second beam sections having juxtaposed first and second inner edges and first and second inner sections extending in from associated of said first and second edges, each inner edge having a plurality of spaced, alternating tabs and recesses extending lengthwise thereof, a thermal barrier between said overlapping tabs to thermally isolate said first and second beam sections, and rivet fastening means to mechanically fasten said overlapping tabs together adjacent said inner edges with said thermal barrier between opposed portions of said overlapping tabs to form a structural composite beam, said fastening means being provided by having the tabs of adjacent beam sections provided with holes, overlapped with a gap between said first and second inner edges.

5. A metal beam as set forth in claim 4 wherein said tabs and recesses are semi-circular.

6. A metal beam with a thermal break between opposite sides comprising:

a first metal beam section including a first base wall portion and a first side wall portion extending transverse to said first base wall portion, a second metal beam section opposite said first beam section, said second beam section including a second base wall portion and a second side wall portion extending transverse to said second base wall portion, said first and second base wall portions being oppositely disposed and having adjacent first and second inner edges, said first and second base wall portions being in an overlapping relation to one another to provide overlapping portions, a thermal barrier between said overlapping portions of first and second base wall portions to thermally isolate said first and second beam sections, and fastening means to mechanically fasten said first and second base wall portions together adjacent said inner edges with said thermal barrier between said overlapping portions of said first and second base wall portions to form a structural composite beam, said first and second beam sections having juxtaposed first and second inner edges, each of said inner edges having a plurality of spaced, alternating tabs and recesses extending lengthwise thereof, said fastening means being provided by having the tabs of adjacent beam sections provided with holes, overlapped and riveted together with the thermal barrier between said overlapping tabs to provide a composite beam with a gap between said inner first and second edges, said first and second beam sections being made from a channel-shaped beam body cut along a longitudinal center line of said beam body with said tabs and holes formed during a cutting and punching operation.

7. A method of making a metal beam with a thermal break between opposite sides comprising the steps of:

providing a first metal beam section including a first base wall portion having a first inner edge and a first side wall portion extending transverse to said first base wall portion, providing a second metal beam section, said second beam section including a second base wall portion having a second inner edge and a second side wall portion extending transverse to said second base wall portion, positioning said first and second base wall portions opposite one another in an overlapping relation to provide overlapping portions with said edges in a juxtaposed relation, positioning a thermal barrier between said overlapping portions of first and second base wall portions, mechanically fastening said first and second base wall portions together adjacent said inner edges with said thermal barrier between said overlapping portions of said first and second base wall portions to thermally isolate said first and second beam sections and to form a structural composite beam, including the step of providing aligned holes in said first and second base wall portions and extending a tubular body through said holes, and flattening the ends of said body to form a rivet with opposed flattened rivet heads.

8. A method of making a metal beam with a thermal break between opposite sides comprising the steps of:

providing a first metal beam section including a first base wall portion having a first inner edge and a first side wall portion extending transverse to said first base wall portion, providing a second metal beam section, said second beam section including a second base wall portion having a second inner edge and a second side wall portion extending transverse to said second base wall portion, positioning said first and second base wall portions opposite one another in an overlapping relation to provide overlapping portions with said edges in a juxtaposed relation, positioning a thermal barrier between said overlapping portions of first and second base wall portions, mechanically fastening said first and second base wall portions together adjacent said inner edges with said thermal barrier between said overlapping portions of said first and second base wall portions to thermally isolate said first and second beam sections and to form a structural composite beam, including the step of providing aligned holes in said first and second base wall portions, overlapping said first base wall portion over said second base wall portion, the hole in said first base wall portion being larger than the hole in said second base wall portion, and swedging a portion of the material surrounding said smaller hole through said smaller hole to form a rivet head.

* * * * *